United States Patent [19]

Parker

[11] 4,175,689

[45] Nov. 27, 1979

[54] APPARATUS FOR CENTERING STRIPS IN ROLLING MILLS AND THE LIKE

[76] Inventor: Calvin E. Parker, 1506 Amber Ct., Ontario, Calif. 91762

[21] Appl. No.: 827,732

[22] Filed: Aug. 25, 1977

[51] Int. Cl.[2] ..... B65H 23/02; B65H 25/26; B65H 27/00

[52] U.S. Cl. ..... 226/190; 74/241; 198/840; 226/20; 226/179

[58] Field of Search ..... 226/20, 19, 18, 45, 226/179, 190, 192; 198/806, 807, 840; 74/241; 242/57.1

[56] References Cited

U.S. PATENT DOCUMENTS

| | | | |
|---|---|---|---|
| 2,372,378 | 3/1945 | Hlavaty | 74/241 |
| 2,752,151 | 6/1956 | Levine | 226/20 |
| 3,052,395 | 9/1962 | Scott | 226/19 X |
| 3,087,665 | 4/1963 | Thomas | 226/19 X |
| 3,756,415 | 9/1973 | Iwatani | 74/241 X |
| 3,973,446 | 8/1976 | Vasilantone | 74/241 |

*Primary Examiner*—Bruce H. Stoner, Jr.
*Attorney, Agent, or Firm*—Harris, Kern, Wallen & Tinsley

[57] ABSTRACT

A strip control system and steering roll which may be utilized in a rolling mill. The steering roll, having a semi-cylindrical outer shell, contacts a strip or web of material being processed. A degree of axial freedom is provided each half of the outer shell. A sensor capable of detecting strip or web off tracking is linked to at least one actuator which may impart an axial force to the outer shell to realign both the shell and material thereon. An opposing spring mechanism acts upon a traverse guide to automatically recenter the outer shell portion not in contact with the material being processed.

7 Claims, 5 Drawing Figures

APPARATUS FOR CENTERING STRIPS IN ROLLING MILLS AND THE LIKE

BACKGROUND OF INVENTION

The present invention relates to rolling mill equipment. In particular, it relates to control devices to maintain a traveling sheet or web of material, such as metal, centered upon rollers along which it is processed.

Any continuous moving web of material, as it progresses over a series of rolls, tend to move from the center of travel to one or the other edge of the rolls. This side-to-side weaving is induced by several factors. For instance, metallic strips can be rolled with a "chambered" shape, a condition in which one edge of the strip is longer than the other; materials may exhibit different degrees of elasticity from one edge to the other; segments may vary across a web; or the joint, or weld, where one continuous coil is joined to another, may be misaligned. Additional contributing factors include inadequate tension, misalignment of machine elements, excessive roll wear or taper, and inadequate structural rigidity.

Strip off tracking (this would encompass such materials as steel, aluminum, rubber, paper, textiles, etc.) forces slower line speeds, damage to equipment and material being processed and major delays when the material tracks off the roll faces completely. A common present-day solution to this problem is the use of steering rolls within the process line. Such present-day rolls are commonly designed to pivot for redirection of off tracking strips. These rolls put pressure on an edge of the moving strip to induce movement to the "tight" side. To be effective such rolls require 180° of strip wrap. Experience has shown such control to be neither positive nor quick enough in response to effect total or accurate strip steering. Additionally, such steering of a strip may result in distortion, deformation, and/or stretching of the material.

These and other problems introduced by pivoted steering rolls have led to attempts to achieve web steering by the imposing forces entirely normal to the desired direction of web travel. In this regard, Avery, et al, U.S. Pat. No. 3,786,076 discloses a complex, sensor-activated steering roll which features a plurality of slats 32, each of which may be made to reciprocate throughout the rotation of a roll body 10. Such reciprocation is coordinated with the positioning of the web upon the roll body 10 to impart the desired pure axial force while the web contacts the slat-surrounded roll body 10. However, due to the fact that each slat 32 has the same null point of reciprocation within a rotation cycle of the roll body 10 and that a plurality of the slats 32, each positioned at a different stage of the rotation cycle of roll body 10 (and, hence, each having a different degree and possibly a different direction of displacement from null orientation) may simultaneously engage the traveling web, this steering roll may introduce web fiber shear stresses.

OBJECTS AND SUMMARY OF INVENTION

The present invention includes a roll having a semi-cylindrical outer shell, both segments of which may be displaced axially both by strip "off tracking" and by the impulse of an actuator. The outer shell segments automatically recenter by the action of opposing springs against traverse guides, to which the segments are rigidly engaged. A sensor detects the "off tracking" of a strip or web of material being processed. When detected by the sensor, one of two oppositely-acting actuators linked thereto is energized to impart a force upon the edge of the segment of the outer shell while the segment is in contact with the strip, to cause a shift of the position of the frictionally engaged strip. The edges of the outer shell are trapezoidally bevelled for maximum actuator steering influence.

An object of this invention is to provide a web control which adjusts the position of a web of material thereon by unitarily imparting a purely lateral displacement force.

Yet another object of this invention is to provide a roller which may be located throughout the stations of a manufacturing process to provide a positive and quick adjustment of position to an off tracking strip or web of material.

Still another object of this invention is to provide a steering roll having a transversely displaceable outer shell which automatically recenters when in contact with no exogenous transverse force components.

Yet another object of this invention is to provide a mechanically simple and easily maintainable means of continually aligning a strip or web of material upon a roll which minimizes stresses, distortion, deformation, and stretching of the material.

Other objects, advantages and features of the present invention will be readily apparent in the following description wherein like numerals represent like features throughout.

DESCRIPTION OF EXEMPLARY EMBODIMENT OF INVENTION

Figure 1:
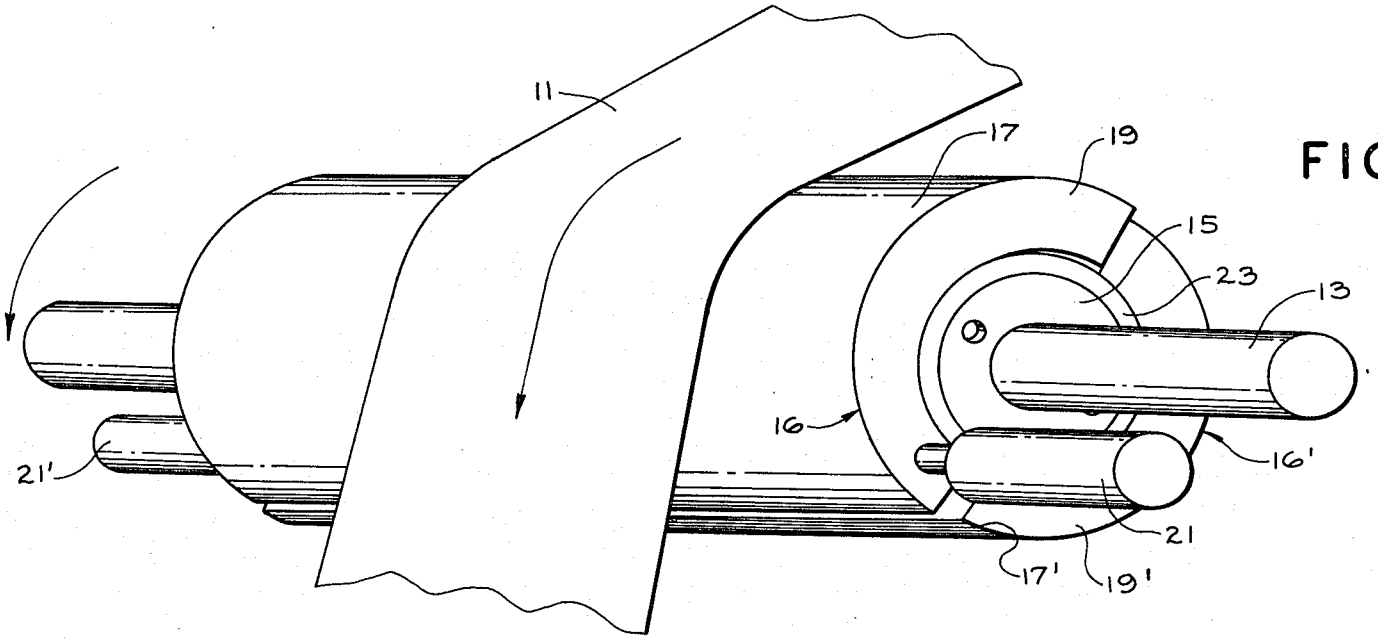
FIG. 1 is a perspective view of a steering roll incorporating the presently preferred embodiment of the roll, web, and actuators.

The steering roll of FIG. 1 is seen employed in the processing of a sheet or web of material 11. Generally, the invention will prove most useful in such manufacturing processes, although useful for obvious variations such as conveyor belt control. A shaft 13, which may either be driven (by standard means) or freely rotating, is joined to the roll at end plate 15. The steering roll is symmetrical and an identical end plate 15' exists at the opposite end of the invention. The end plates 15, 15' are fixedly engaged to shaft 13 by any of a number of conventional fastening means. In practice such attachment may be achieved by set screws when applied to use with small size rolls. Other methods, such as welding, may be found to be more satisfactory when larger rolls are employed. The roll includes a two piece outer shell 16, 16' and an inner shell 23.

Figure 4:
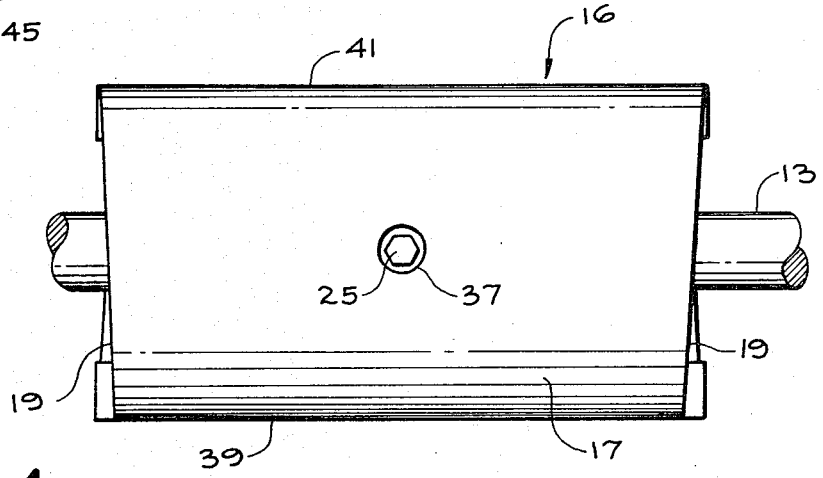
FIG. 4 is a plan view of the outer shell of the steering roll of FIG. 1.

The sheet of material 11 is processed by traversing alternating semi-cylindrical surfaces 17, 17' of the outer shell. Manufacture by sheet rolling of various materials is common and need not be discussed in detail. The (counterclockwise) rotating outer shells 16, 16' have corresponding outer edges 19, 19'. Oppositely-impulsing actuators 21,21' are located on either side of the steering roll for contact with edges 19, 19' when either actuator 21, 21' is energized. The actuators 21, 21' may be one of a number of standard means in which an internal force is translated into the movement of a piston or other protruding element. It is significant that, as illustrated in FIGS. 1 and 4, the sloping edges 19, 19' of semi-cylindrical segments 17, 17' are so designed that, during that portion of a revolution in which segment 17 or 17' is in contact with strip 11, the corresponding edge 19 or 19' becomes progressively closer (i.e., approaches) to the oppositely positioned actuators 21, 21' at both ends of the segments. As will be seen below, such geometry allows infinite actuator steering influence, dependent upon the amount of bevel contacted by the actuator 21 or 21' during each revolution.

The inner shell 23 is fixedly engaged at its ends to each of end plates 15, 15'. The engagement is achieved by any of a number of standard means, such as discussed in relation to the junction of the end plates 15, 15' with shaft 13. The inner shell 23 and semi-cylindrical outer shell segments 16, 16' are so joined that each segment possesses an axial or transverse degree of freedom with respect to the inner shell 23, an important feature of the present invention.

Figure 2:
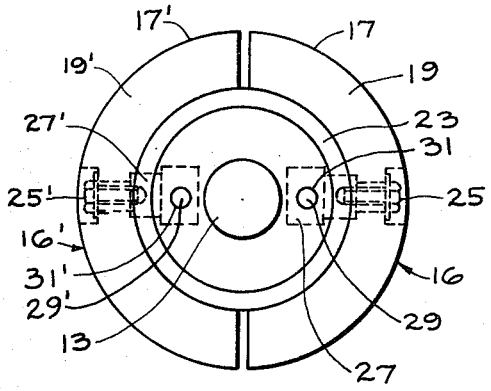
FIG. 2 is a frontal view of the steering roll of FIG. 1.

FIG. 2 presents an end view of the steering roll of the present invention showing semi-cylindrical or split design of the outer shell, formed of segments 16, 16'. Bolts 25, 25' are countersunk into the faces 17, 17' of the segments 16, 16' and provide rigid engagement of the outer shell segments 16, 16' to transverse guides 27, 27'. The transverse guides 27, 27' are, in turn, rigidly engaged to guide shafts 29, 29', with each guide shaft at each end in slidable engagement with a pair of guide slots 31, 31' positioned in each of end plates 15, 15'. Alternatively, the shafts 29, 29' may be fixed in the end plates 15, 15', and the guides 27, 27' may slide on the shafts 29, 29'.

Figure 3:
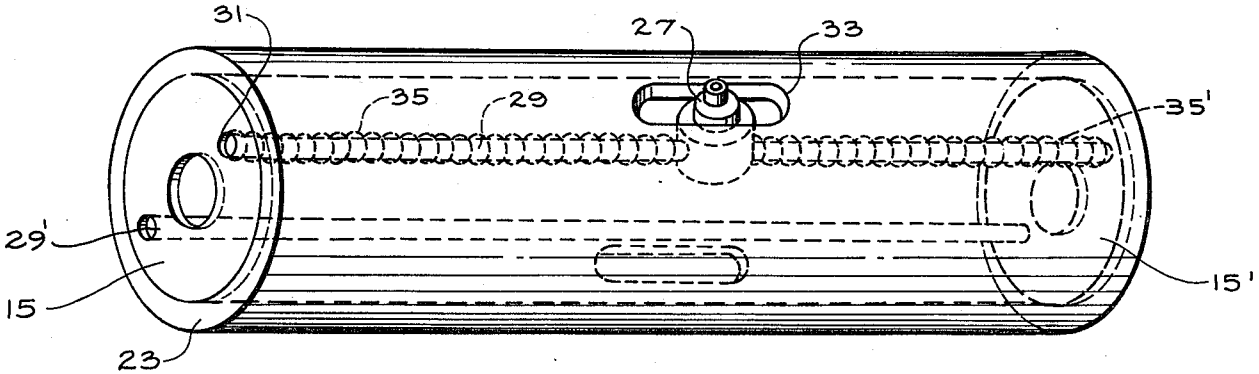
FIG. 3 is a perspective view of the mechanisms of the inner shell of the steering roll of FIG. 1.

FIG. 3 is a detailed view of the inner shell 23 utilizing transparency to illustrate the operative mechanisms associated therewith. The traverse guide 27 and guide shaft 29 together form a shiftable unit. For purposes of clarity only the traverse guide mounted on guide shaft 29 is illustrated in FIG. 3. In practice, at least one traverse guide 27 is associated with each of guide shafts 29, 29' to engage each of the two outer shell segments 17, 17'. In fact, any number of guides 27 (with, of course, a corresponding number of slots 33 provided therefor) may be joined to a guide shaft 29. Length of roller, type of use, location in process, etc., will dictate the number to be employed within the scope of the present invention.

An axial slot 33 is provided in the hollow cylindrical wall of inner shell 23 for the guide 27 to allow axial movement of traverse guide 27 relative to inner shell 23. The overall design of the inner shell 23 in conjunction with guide slots 31, 31', axial slot 33 and guide shaft 29 is such that a traverse guide 27 will abut an axial slot 33 before either end of shaft 29 can disengage either end plate 15, 15'. Additionally, as the abutting of a traverse guide 27 against an axial slot 33 results in a loss of sensitivity of the attached outer shell segment of strip "off tracking", the actuators 21, 21' are calibrated to act in conjunction with sensing equipment to recenter outer shells 13, 13' before such an occurrence.

Oppositely disposed centering springs 35, 35' are provided on each side of traverse guide 27. Each spring 35, 35' abuts both the guide 27 and one of end plates 15, 15', providing oppositely acting and equal forces upon the otherwise free floating traverse guide 27. These forces provide automatic recentering of the traverse guide 27, and hence its attached outer shell segment 16, when it is free from the external forces caused by frictional engagement of the segment with an off-tracking strip 11 and/or the corrective impulse of an actuator.

The overall geometry of outer shell segment 16 and the shape of edges 19 thereof are shown in FIG. 4. Attachment bolt 25 is located in recess 37 of segment 16 and serves to fixedly engage outer shell segment 16 to traverse guide 27. Such recessed orientation prevents contact of the bolt with the web or strip 11 being processed. The sloping edges 19 in plan view give the segment 16 a trapezoidal appearance. Each of segments 16, 16' of the semi-cylindrical outer shell thus has a long interior edge 41 and a short interior edge 39 oppositely disposed within the outer shell configuration. This shape allows maximum actuator influence over the axial position of the segments 16, 16' (and steering of the frictionally engaged web or strip 11) during the portion of a revolution the edge is opposite the actuator. If, in contrast, outer shells were to provide a parallelogram (plan view) shape, the protruding contact element of one actuator 21, 21' would be required to project through a progressively larger distance throughout the portion of a revolution that a given segment of the outer shell was rotating and in contact with web or strip 11 for the actuator 21 to influence the axial position of the segment 17 or 17'.

Figure 5:
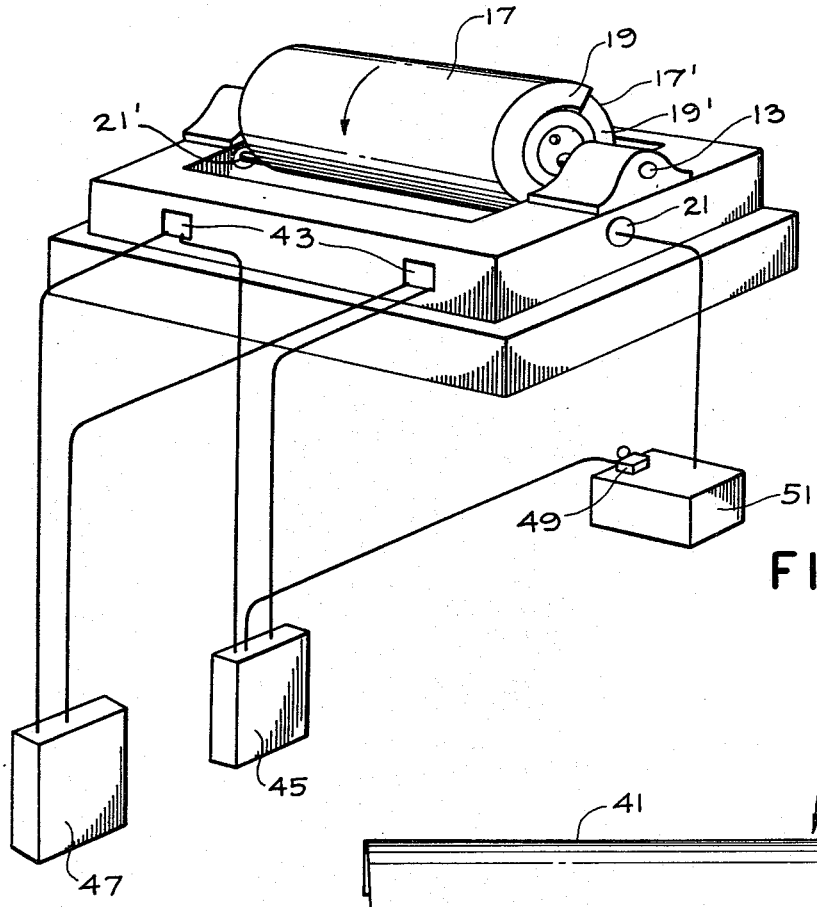
FIG. 5 is a perspective view of a strip centering system incorporating the steering roll of FIG. 1.

FIG. 5 shows the linkage of a sensor 43, actuators 21, 21' and the steering roll of the invention to form an integrated strip control system. The exact configuration illustrated is not intended to limit the scope of the invention as any of a variety of sensors 43 and actuators 21, 21' may be effectively employed in conjunction with the control roll of the present invention. A basic sensing system is shown to consist of a sensor 43, a signal interpretation device 45, lamp ballast 47 for the sensor, servo valve 49 and power unit 51 to apply the force to the control roller by means of actuator 21. The sensor 43 shown may be a light source and photoelectric sensor. Such a sensor 43 sends a continuous signal (normally low voltage dc) to the signal processor 45 which simply measures a voltage difference from side to side and proportionately activates the power unit 51 which provides the desired force to either of actuators 21, 21'. The sensor illustrated in FIG. 5 detects improper displacement (as calibrated by the state of revolution) of edges 19, 19' of outer shell segments 17, 17'.

Movement or misalignment of the edges 19, 19' might be sensed by any of a multitude of alternative conventional means including air system sensors that function with an air source and pitot tube sensor, mechanical "whisker" type limit switches, pressure/force contacting switches, magnetic sensors, infrared sensors, etc. In all embodiments the actuators 21, 21' are deactivated when in their compressed position. In the sensor 43 of FIG. 5, a light source is allowed to collimate to the light detector generating the signal to be processed.

In operation, a traveling web or strip 11 is contacted during alternative half-revolutions by each of segments 16, 16' of the semi-cylindrical outer shell. "Off tracking" of the strip or web 11 will be reflected in a non-centered position of the segment 16 or 16' in contact with strip 11, due to its frictional engagement with the contacted segment. The sensor 43 detects the positioning of the segments 16, 16' and associated edges 19, 19' at all times. Improper position will be detected by sensor 43 in conjunction with signal processor 45 to generate an output signal. The signal generated serves to activate a response from either of the actuators 21, 21' according to the "adjustment" required by web or strip 11. The actuator which responds to such signal is, of course, that nearest the off-tracking edge 19 or 19', as a counterpositioning thrust is to be generated. The magnitude and timing of the thrust is dependent upon system factors such as r.p.m., the portion of the revolution at which the actuator is to contact the edge, etc. Techniques for properly gauging and timing such thrust are well known in the art of machinery design.

At a later stage of the revolution, after a corrective impulse has been imparted by an actuator to the edge of the outer shell segment, the segment is free of intimate contact with strip 11 while the strip 11 is contacted by the outer shell's other segment. Under no force/influence from the web 11 or an actuator, the segment will be returned to its centered position by the action of centering springs 35, 35' on the segment's traverse guide. A new half rotation cycle of contact between the segment and the strip with possible realignment by actuators 21, 21' may now be initiated with the axially centered segment. Such automatic realignment minimizes the complexity required of the system's sensing and related signal processing elements.

Thus it is seen that there is achieved a simplified strip control system and steering roll for centering of a strip or web of material being processed by unitarily imparting to the web a purely axial alignment force.

I claim as my invention:

1. A steering roll for a strip handling system having a shaft, which roll comprises:

(a) an inner member;

(b) attachment means fixedly engaging said inner member to said shaft for rotation of said inner member with said shaft;

(c) a hollow cylindrical outer shell positioned over said inner member and having two substantially semi-cylindrical segments;

(d) shift means carried within and projecting through said inner member for attaching said outer shell segments to said inner member so that said outer shell segments are held rigidly away from said inner member in the radial direction, and rotate with and may be axially displaced with respect to said inner member; and (e) spring means carried in said inner member and disposed parallel to the axis of said shaft and engaging said shift means for urging said shift means to a centered position.

2. A steering roll as defined in claim 1 wherein said outer shell segments move axially independently of each other.

3. A steering roll as defined in claim 2 wherein said attachment means comprises a pair of end plates with each of said end plates being rigidly engaged to said inner member at opposite ends thereof and to said shaft.

4. A steering roll as defined in claim 2 wherein said shift means comprises:

(a) a plurality of traverse guides, each guide having a base portion and a radial portion;

(b) a plurality of guide shafts carried in said inner member, with each of said guides engaged at its base portion to a guide shaft; and (c) means for attaching said segments to said radial portions of said guides, with said guides and segments translating axially relative to said inner member.

5. A steering roll as defined in claim 4 including:

(a) a pair of guide slots located in opposite ends of said inner member to accept in slidable engagement an end of each of said guide shafts; and (b) an axial slot in said inner member for each of said guides to allow the axial movement of said traverse guide relative to said inner member.

6. A steering roll as defined in claim 4 wherein said spring means comprises a pair of centering springs oppositely disposed along each said guide shaft, each of said springs encircling said guide shaft and abutting said base portion of the traverse guide attached thereto and an end of said inner member.

7. A steering roll as defined in claim 6 wherein the exterior edges of each of said semi-cylindrical segments of said outer roll are sloped disposed with respect to each other.

* * * * *